US005239833A

United States Patent [19]

Fineblum

[11] Patent Number: 5,239,833

[45] Date of Patent: Aug. 31, 1993

[54] HEAT PUMP SYSTEM AND HEAT PUMP DEVICE USING A CONSTANT FLOW REVERSE STIRLING CYCLE

[75] Inventor: Solomon S. Fineblum, Rochester, N.Y.

[73] Assignee: Fineblum Engineering Corp., Fairfield, Iowa

[21] Appl. No.: 772,453

[22] Filed: Oct. 7, 1991

[51] Int. Cl.[5] ..... F25B 9/00; F25D 9/00

[52] U.S. Cl. ..... 62/6; 62/401; 62/402; 62/467

[58] Field of Search ..... 62/499, 6, 401, 402, 62/467

[56] References Cited

U.S. PATENT DOCUMENTS

| | | | |
|---|---|---|---|
| 3,189,262 | 6/1965 | Hanson et al. | 62/499 X |
| 3,426,525 | 2/1969 | Rubin | 62/6 X |
| 3,483,694 | 12/1969 | Huber et al. | 62/6 X |
| 3,487,424 | 12/1969 | Leger | 62/6 |
| 3,509,718 | 5/1970 | Fezer et al. | 62/6 X |
| 3,537,256 | 11/1970 | Kelly | 62/6 X |
| 3,537,269 | 11/1970 | Kelly | 62/6 |
| 4,117,695 | 10/1978 | Hargreaves | 62/499 X |
| 4,211,093 | 7/1980 | Midolo | 62/513 X |
| 4,494,386 | 1/1985 | Edwards et al. | 62/499 X |

OTHER PUBLICATIONS

J. Wurm et al "Stirling and Vuilleumier Heat Pumps" McGraw-Hill 1991, pp. 24, 25, 54, 52.

Proc. 26th Intersociety Energy Conversion Engnr Conference, vol. 5, *IECEC*-91, Aug. 1991, American Nuclear Soc.

K. Hamaguchi et al. "Effects of Regenerator Size Change on Stirling Engine Performance" 26th IECEC, vol. 5 1991.

T. Suganami et al. "Development of Small Stirling Engine Heat Pump System", 26th *IECEC*, vol. 5, 1991 p. 262.

W. C. Daley "Stirling Engine Performance Optimization with Different Working Fluids" 21 IECEC, 1986, vol. I p. 575.

O. C. Johnson et al., "Improved Stirling Engine Performance Using Jet Impingement" 17th *IECEC* 1982, 1847 page, Aug. 1982.

*Primary Examiner*—Henry A. Bennet
*Assistant Examiner*—C. Kilner

[57] ABSTRACT

The four processes of a reverse Stirling heat pump cycle; isothehermal compression with the heat of compression being transmitted to a constant, relatively high temperature sink, regenerative cooling, isothermal expansion with heat flow from a cooler, constant temperature source followed by regenerative heating from the heat derived from the previously compressed gas are all performed with constant rather than intermittent flow. A constant flow, constant volume counter-flow heat exchanger, placed between the compressor and expander, rather than an alternately heated and cooled heat storage matrix, provides for the steady flow regenerative heat transfer as required for a steady reverse Stirling cycle heat pump. This invention therefore provides for increased heat pump rate per unit volume.

6 Claims, 7 Drawing Sheets

HEAT PUMP SYSTEM AND HEAT PUMP DEVICE USING A CONSTANT FLOW REVERSE STIRLING CYCLE

BACKGROUND

1. Field of the Invention

This invention is a reverse Stirling cycle heat pump.

2. The Prior Art

Heat pumps are now driven by electrically or engine driven compressors at relatively low total thermal efficiency. The reversed Rankine cycle heat pumps require refrigerants which are hostile to our environment. The substitutes proposed for the CFC based refrigerants are either very expensive or toxic or inflammable. Air system heat pumps based on a reversed Brayton cycle are relatively inefficient as are absorption heat pumps.

Reverse Sterling cycle heat pumps are capable of relatively high total thermal efficiency without the use of CFC's. A reverse Stirling cycle consists of a cooled isothermal-thermal compression, constant volume reversible cooling, isothermal-thermal expansion, and finally reversible constant-volume heating.

Available embodiments of Stirling cycle heat pumps operate with discontinuous, unsteady flow during four separate changes of state accomplished by a sequence of piston movements and the alternate movement of warmer and cooler gas in opposite directions through a heat storage matrix. All the Stirling cycle examples cited in the latest literature show discontinuous flow devices. This time consuming sequence results in a low rate of heat removal for a fixed size of equipment in a Stirling cycle heat pump and such units are expensive for the heat pumping rate achieved.

Constant flow, constant volume thermal compression with regenerative heat transfer as required for constant flow Stirling cycle function is considered impossible by Stirling cycle heat pump authorities as noted J. Wurm, J. A. Kinast, T. R. Roose, W. R. Staats in the recent publication, "Stirling and Vuillemier Heat Pumps," McGraw-Hill, 1991, state on page 24, "A recuperative heat exchanger that can achieve compression or expansion of a fluid at constant specific volume has not yet been invented. Regenerative heat exchange is also not possible because the regenerator would have to move from one flow stream to the other which seems impossible because the two streams have varying pressures." This invention solves these problems.

An air-only air-conditioner invented by Dr. Thomas C. Edwards noted. "Air-only air-conditioner surprises auto makers," Machine Design, Mar. 6, 1975, p. 10, has a vaned compressor and expander operating on the same slotted rotor as in one embodiment of the present invention. However, the unit lacks direct thermal contact with a heat sink or a heat source for isothermal operation. In addition, there is no integration, on the device nor on the system level, of a regenerative constant volume heat exchanging as in the present invention.

Kelly (U.S. Pat. No. 3,537,269) shows two rotors, one acts as a displacer, "... in a similar manner to that of the reciprocating displacer piston ... " (Column 1, line 55). Thermal storage is required between cycle phases. (Column 2, lines 27 and 33). The alternate and repeated heating and cooling of filaments or other materials between cycles is inherently inefficient and gets worse with increased heat pump speed.

$$ln(\ T, t/\ T\ \text{Initial}) = -t/(\text{RC THERM})$$

where RC THERM=$\rho cV/hA$=THERMAL TIME CONSTANT and ( T, t)=Temperature difference between matrix and stream at time t.

However, cycle frequency=1/t

THEREFORE:

$$\text{lN}(\ T, T/\ T\ \text{Initial}) = +\text{Freq (RC therm)}$$

Thermal error, the failure of matrix material and gas stream, and consequently, the two streams, to approach the same temperature, which is a positive function of frequency, increases with frequency and heat pump speed. This theoretical prediction has been verified experimentally. The temperature difference between the heated stream and the cooled stream does increase with regenerator cycle frequency. (FIG. 11, K. Hamaguchi et al. "Effects of Generator Size Change", 26th Intersociety Energy Conversion Engineering Conference, August 1991, Volume 5, page 298).

The reheat loss, within the regenerator also increase with cycle frequency (FIG. 10 of ibid.). Therefore, heat exchanger effectiveness along with heat pump COP can be expected to drop with regeneration frequency and heat pump speed in alternately heated and cooled heat exchangers. In actual practice, this happens (FIG. 4*a*. Suganami et al., "Development of Small-Scale Stirling Engine Heat Pump System", 26th I.E.C.E.C., August 1991, Volume 5, page 264).

The reference selects air as the working gas which has a poor combination of heat transfer coefficient and specific heat to require a relatively large heat pump for the same capacity as hydrogen or helium (J. C. Daley, et al. "Stirling Engine Performance Optimization With Different Working Fluids "21st I.E.C.E.C., August 1986, Volume 1, page 275).

T. C. Edwards et al. (U.S. Pat. No. 4,494,386) teach a rotary compressor in a vapor—compression refrigeration system with a means of reducing friction between the vane tips and the stator wall. Functionally, there is no isothermal expansion, no regenerative heat transfer and no possibility of operating a Stirling cycle. Structurally, there is no integration of compressor, regenerator and expander in one enclosed device.

L. W. Midolo (U.S. Pat. No. 4,211,093) teaches a two-stage rotary compressor within one case. The sliding vane compressor drives a vapor-compression cooling system. There are no structural provisions or capability for a reverse Stirling cycle heat pump.

P. A. M. Leger (U.S. Pat. No. 3,487,424) teaches synchronized rotary displacers that "periodically" drive gas into hot and cold chambers and sequentially through a regenerator to achieve a reverse Stirling cycle heat pump. Valves are required to reverse the flow through a regenerator 7 wherein storage material is periodically heated and cooled and the gas flowing therein is alternately cooled and heated. In contrast, the present invention has no timed valves and no periodic reversing of flow and no thermal storage regenerators.

R. R. Hanson and E. A. Braden (U.S. Pat. No. 3,189,162) teach a rotary compressor to drive a vapor-compression space cooler. There are no provisions for any of the essential Stirling cycle heat pump processes. The structure has no heat exchanger for regeneration nor any capability to perform such function.

THE OBJECTS AND ADVANTAGES

Accordingly, the object of the present invention is to provide for the superior thermal efficiency of the Stirling cycle heat pump in a device with higher capacity for any fixed size of unit.

Another object of the present invention is to provide for a constant volume counter flow regenerative heat exchanger to simultaneously generate thermal pressurization and thermal depressurization in two separate streams at two different and varying pressures at relatively high flow rates.

Another object of the present invention is to provide a practical substitute for reversed Rankine cycle heat pumps which use environmentally harmful, toxic and/or expensive refrigerants.

Another object of the present invention is to provide for a steady flow variation of the classical intermittent reversed Stirling cycle to achieve higher heat pumping rate per unit volume.

Another object is to eliminate the heat transfer lags and penalties of an alternately heated and cooled thermal storage.

Further objects and advantages will become apparent from a consideration of the ensuing description and drawings.

DESCRIPTION OF SOME PREFERRED EMBODIMENTS

Figure 1:
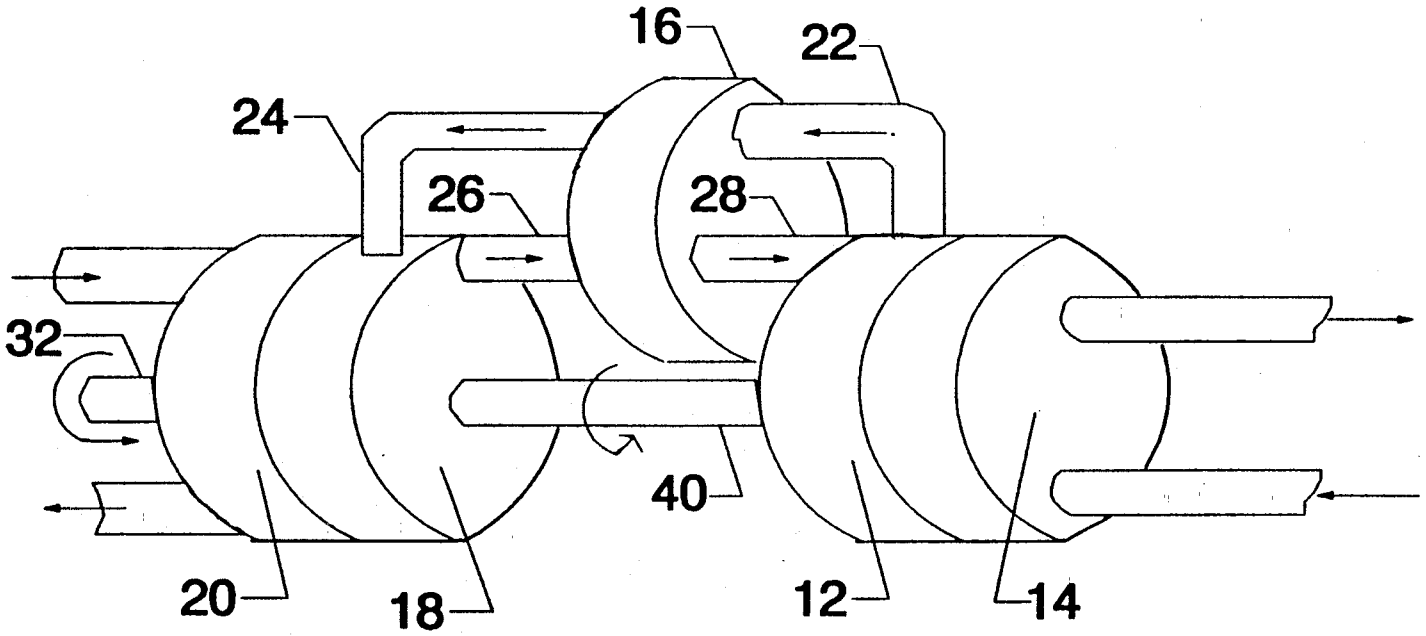
FIG. 1 Shows a physical embodiment of constant flow reverse Stirling cycle heat pump.
Figure 1A:
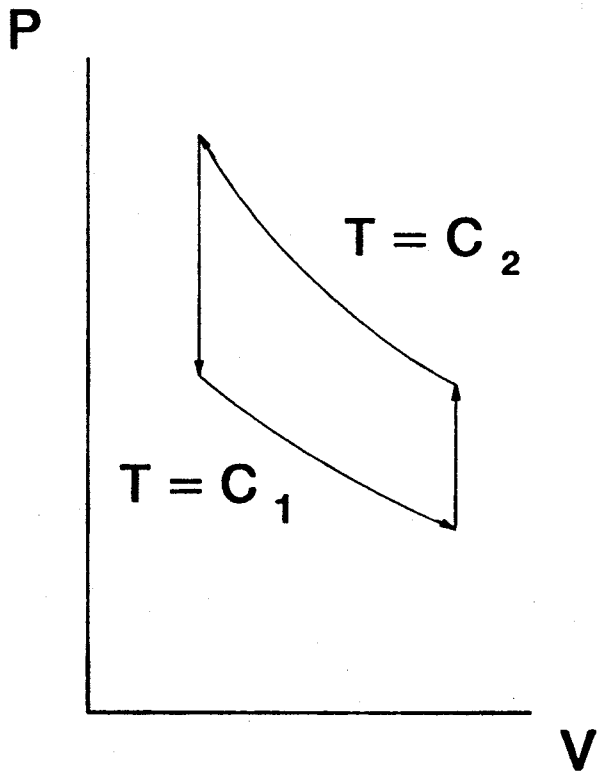
FIG. 1*b* Shows a PV diagram of reverse Stirling cycle.
Figure 2:
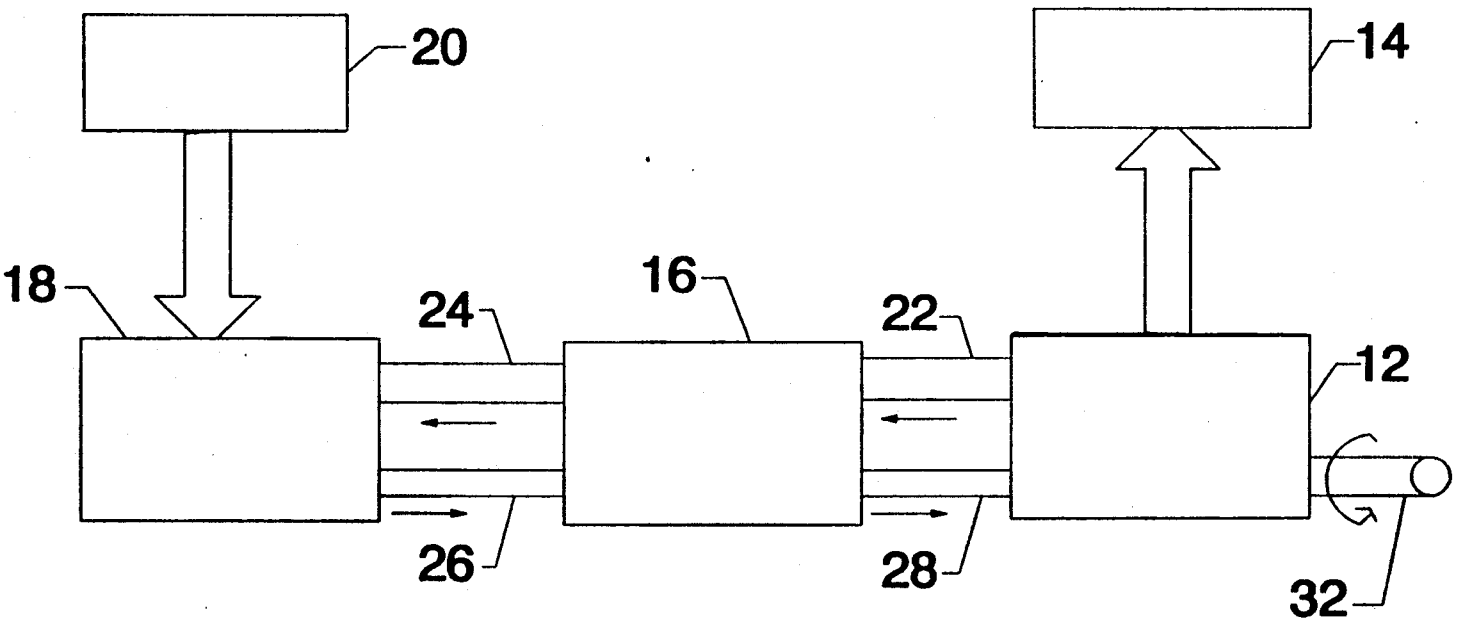
FIG. 2 Shows a schematic diagram of reverse Stirling cycle heat pump system.

FIG. 1*a* and FIG. 2 show a physical and schematic representation of a reversed Stirling cycle heat pump system with constant flow. The system comprises a separate cooled constant flow compressor 12 in which the gas is isothermally compressed, and which is in intimate heat transfer contact with a heat sink 14. The heat of compression is absorbed from compressor 12 into heat sink 14. Compressor 12 can be an constant flow compressor that can be significantly cooled. Compressor outlet connection 22 of constant flow compressor 12 leads to the warmer, high pressure portion of a separate constant volume reversible heat exchanger 16 in which the gas is cooled. The outlet of constant volume reversible heat exchanger 16 leads through expander inlet tubing 24 into a separate constant flow expander 18 which is in intimate heat transfer contact with a relatively low temperature heat source 20. The heat of expansion is isothermally absorbed into expander 18 from heat source 20 as desired. Expander 18 can be any constant flow expander that can absorb heat isothermally during expansion. The outlet of constant flow expander 18 leads through expander outlet tubing 26 to the cooler, low pressure channel of constant volume reversible heat exchanger 16 in which the gas is heated at constant volume and thermally pressurized. The outlet of the constant volume reversible heat exchanger 16 leads through compressor inlet tubing 28 into the inlet of constant flow compressor 12 which is driven by a motor 30 through a drive shaft 32 to complete the reverse Stirling cycle shown in FIG. 1*b*. As a result, a higher rate of Stirling cycle heat pumping is achieved than in sequential Stirling cycle heat pumps.

Figure 3:
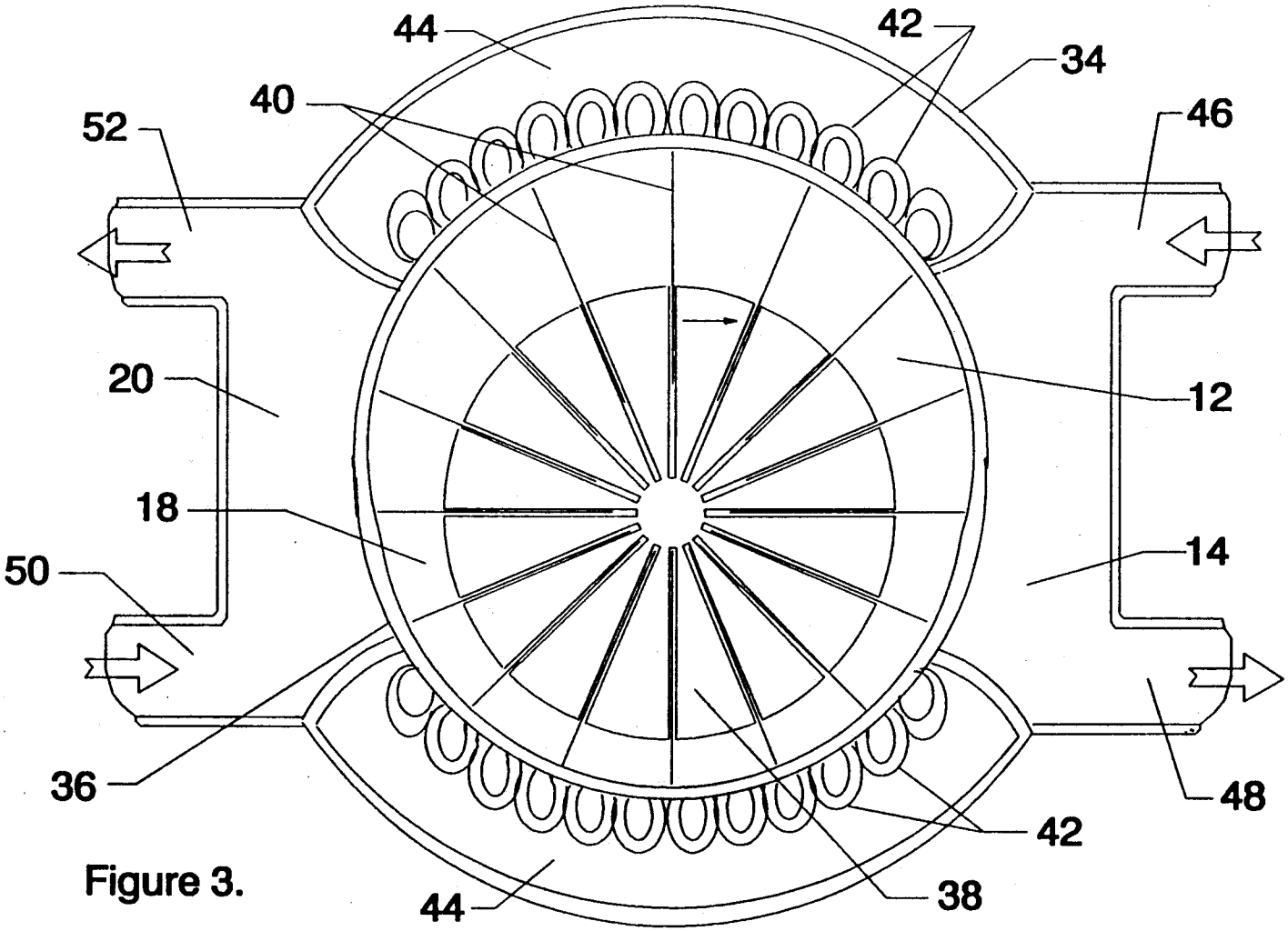
FIG. 3 Shows an cross-sectional view of an integrated heat pump.

FIG. 3 shows a cross-sectional view of a constant flow reverse Stirling cycle heat pump 34 with a sealed enclosure 36, a slotted rotor 38, circularly moving partitions in the form of vanes 40, nine or more effective, in the slots of slotted rotor 38 which extend radially outward. Vanes 40 are free to slide radially within the slots of slotted rotor 38. A drive shaft 31 drives slotted rotor 38. The internal surface of sealed enclosure 36 is so shaped as to form a continuous four segment channel 37 surrounding vanes 40 in a close fit.

A first segment 12 of enclosure 36 has an outer wall with a decreasing radial distance from slotted rotor 38, which acts to force vanes 40 to move inward within the slots of slotted rotor 38 with the volume between vanes 40, being thus reduced. First segment 12 acts as a compressor.

A second segment 13 of channel 37 has an outer wall with a constant radial distance from slotted rotor 38 which permits vanes 40 to move through constant radial distance segment 13 with no radial motion with the volume between vanes 40 such that the volumes of gas trapped between vanes 40 within second segment 13 are equal and constant as the gas therein is cooled and thermally depressurized.

A third segment 18 of channel 37 within sealed enclosure 36 has an expanding radial distance from slotted rotor 38 such that vanes 40 will be radially extended so that the volume of gas trapped between vanes 40, which are outwardly moving, is thus expanded.

A fourth segment 17 of channel 37 formed within sealed enclosure 36 has an outer wall with a constant radial distance from slotted rotor 38 which permits vanes 40 to move through segment 17, the constant radial distance segment with no radial motion. As a result, the volume of gas trapped between vanes 40 within fourth segment 17 remains equal and constant. The slotted rotor 38 constantly drives vanes 40 from first segment 12, to second, third, and fourth segments, 13, 18 and 17, respectively, in continuous sequence. Sealed enclosure 36 includes a heat transfer encouraging construction, such as a very thin, highly heat conductive wall between heat sink 14 and first segment 12, the decreasing volume segment, of continuous, four segment, channel 37 so that the compression is performed isothermally or near isothermally.

Heat pump 34 also includes aligned heat transfer tubes 42, of highly heat conductive material, and containing conductive fluids, preferably with a high coefficient of thermal expansion, between two constant volume segments 13 and 17 to form a constant volume regenerative heat exchanger. Tubes 42 are so aligned that the upstream section of segment 13, the warmer, compressed constant volume segment is in enhanced thermal contact with the downstream end of segment 17, the cooler expanded constant volume segment. Intermediate sections of two constant volume segments, 13 and 17, are in enhanced heat transfer contact. Similarly, the downstream end of segment 13 and the upstream end of segment 17, are in intimate heat transfer contact. As a result, there is a minimum temperature difference between constant volume segments 13 and 17. Heat pipes and solid rods of heat conductive metal could be effective substitutes for fluid filled heat transfer tubes 42.

In addition, sealed enclosure 36 also includes a heat transfer enhancing means between cooled heat source 20 and third segment 18, the expanding volume segment which acts as a heat absorbing isothermal expander. In addition, heat sink 14 is supplied with cooling fluid through heat sink inlet tube 46. The heat sink cooling fluid leaves heat sink 14 through heat sink outlet tube 48. The heat source is provided with fluid through heat source inlet tube 50. The cooled fluid leaves heat source 20 through heat source outlet tube 52. The flowing coolant in heat sink 14 may be forced against the outer surface of sealed enclosure 36 by jet impingement to stimulate a higher rate of heat transfer as demonstrated. (D. C. Johnson et al. "Improved Stirling Engine Performance Using Jet Impingement", 17th I.E.C.E.C. August 1982, Page 1845–49, IEEE 1982) As a result:

The gases in first segment 12, the compressor segment, with inward motion vanes 40 will be compressed in enhanced heat transfer contact with heat sink 14 with approximately isothermal compression. After the gas is compressed, it experiences constant volume thermal pressure reduction in second segment 13 as the gas travels between vanes 40 therein which have a fixed radial position while losing heat to fourth segment 17, the cooler, expanded constant volume segment through aligned heat transfer tubes 42. The cooled high pressure gas is isothermally expanded within third segment 18, the expanding segment of channel 37. Segment 18, which is in enhanced heat transfer contact with heat source 20. Vanes 40 move outward to increase the volume of the gas trapped between vanes 40. Heat enters segment 18 from heat source 20 to thereby cool heat source 20 and fluids therein. Thus, constant flow, endothermic and approximately isothermal expansion and heat absorption occurs there as desired. The low pressure gas then experiences constant volume thermal compression in fourth segment 17 wherein the gas moves trapped between vanes 40 which has a fixed radial position. The low pressure gas is heated by the heat from second segment 13, the compressed constant volume segment. The heat for this thermal compression is transmitted to the gas therein through aligned heat transfer tubes 42. Gas re-enters first segment 12, the compressor segment, wherein the gas is again compressed, approximately isothermally, in intimate heat transfer contact with heat sink 14 and rejecting heat of compression to heat sink 14 to continue steady heat pump operation with the advantages of Stirling cycle efficiency and greater Stirling heat pump performance.

Figure 4:
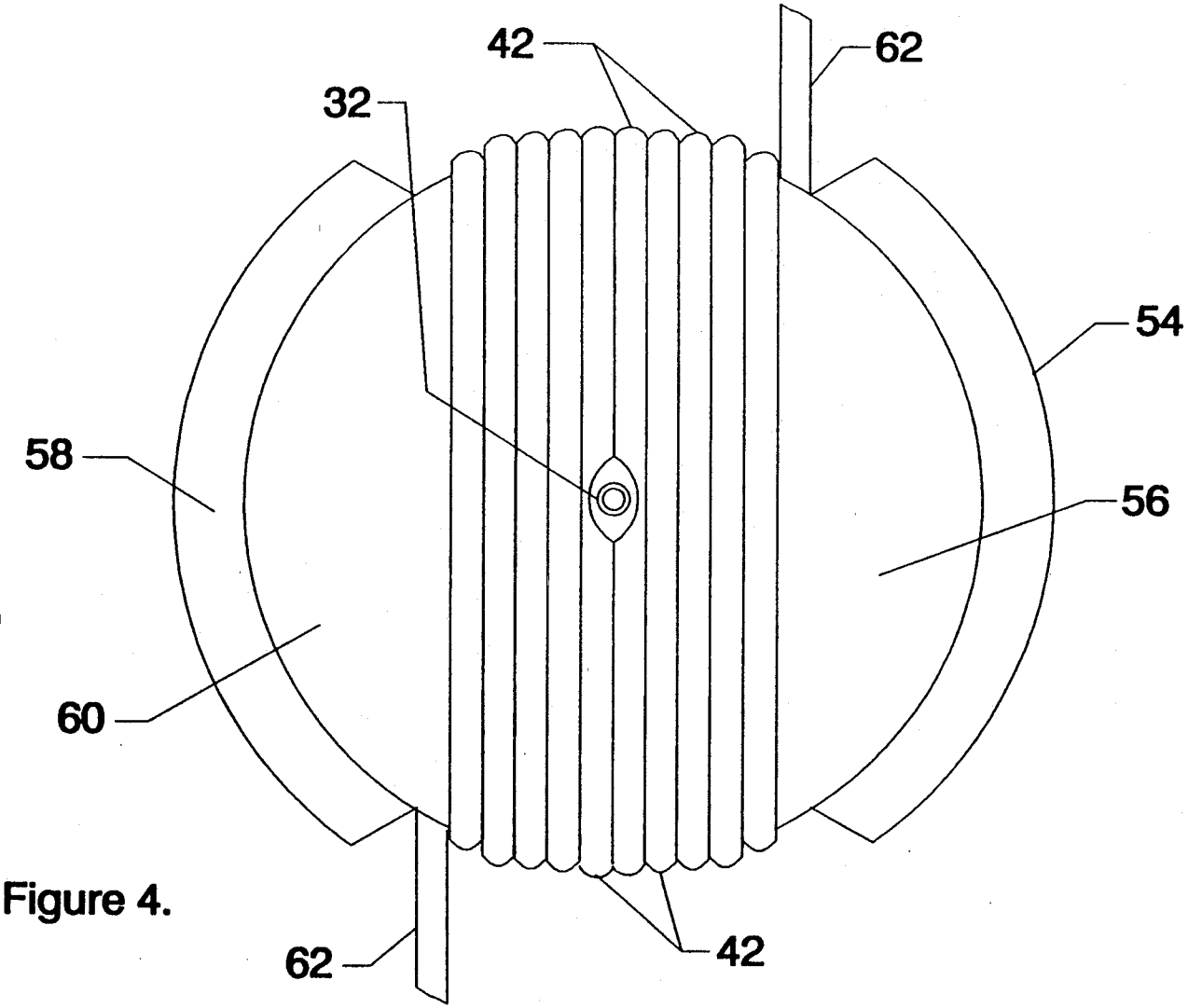
FIG. 4 Shows an exterior view of another integrated heat pump embodiment with the outer insulation removed.

FIG. 4 shows integrated reverse Stirling cycle heat pump 34 with exterior insulation 44 removed. Integrated heat pump 34 is equipped with heat transfer fins 54 spaced along the length of outer wall 56 of isothermal compressor segment 12, as well as heat transfer fins 58 along outer wall 60 of isothermal expander segment 18. Vertically oriented heat transfer tubes 42 are shown without exterior insulation. Insulated partitions 62 divide the region which contains warm fins 54, which are to receive heat from isothermal compressor segment 12 through isothermal compressor outer wall 56, from the cooler region which contains cool fins 58 and which is to give up heat into the isothermal expander segment 18 through isothermal expander outer wall 60. A shaft 32 enters the body of integrated heat pump 34 between two central oriented heat transfer tubes 42 past a seal, not shown, to drive slotted rotor, not shown, as required to perform the thermodynamic processes necessary for reverse Stirling cycle heat pumping.

Figure 5:
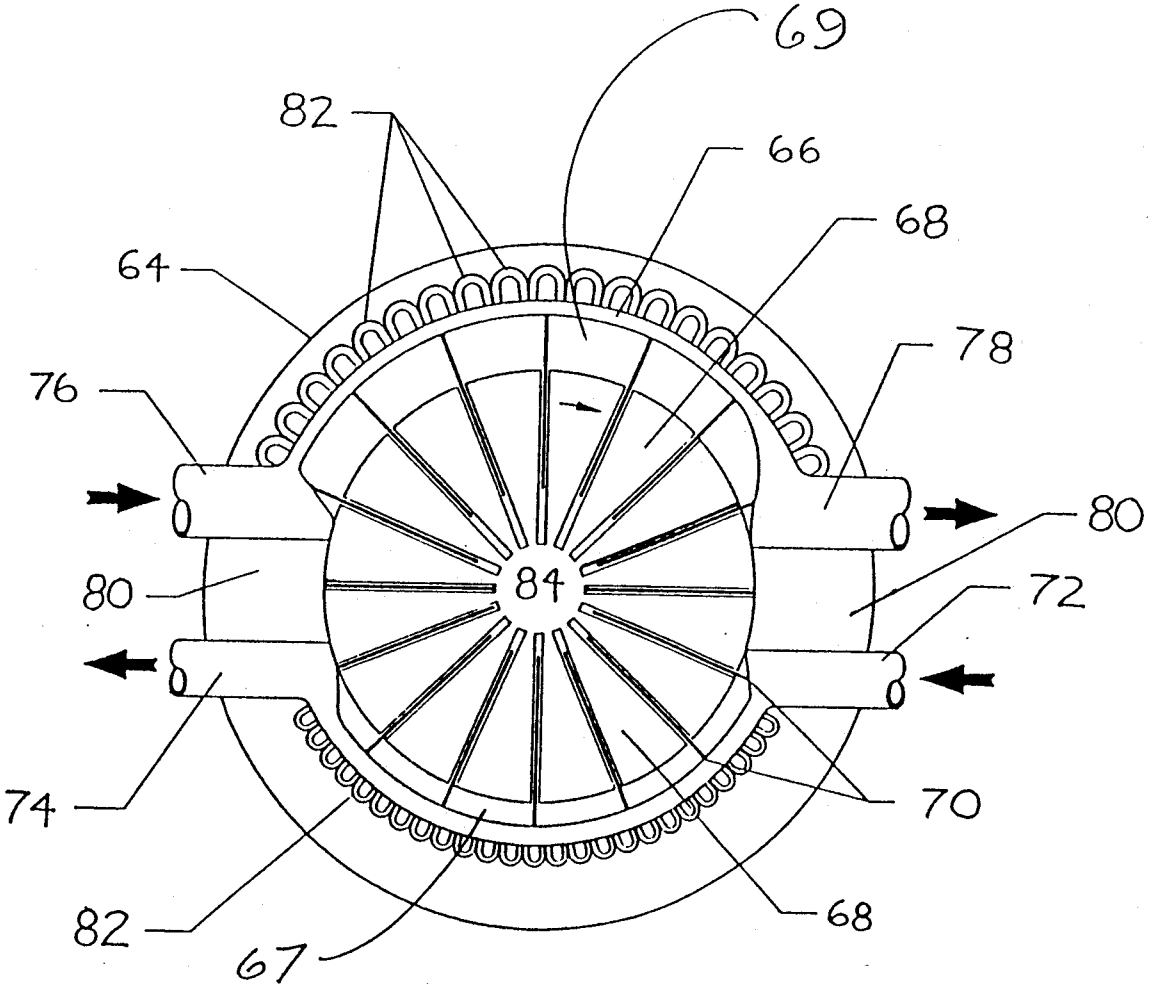
FIG. 5 Shows an interior cross-sectional view of another open reversed Stirling cycle heat pump embodiment.

FIG. 5*a* shows a cross-sectional view of constant flow reverse Stirling cycle heat pump 35 which is identical to heat pump 34 as shown in FIG. 3 except that insulation 73 is extended and shaped to insulate the upstream portion of compressor segment 12 and the upstream portion of segment 18, the expanding volume segment. Heat pipes or heat conductive metal rods could be effective substitutes for fluid filled heat transfer tubes 42.

There are also heat transfer augmentation means between cooled heat source 20 and central and downstream portion of third segment 18, the expanding volume segment which acts as a heat absorbing isothermal expander.

Heat sink 14 is supplied with cooling fluid through heat sink inlet tube 46. The heat sink cooling fluid leaves heat sink 14 through heat sink outlet tube 48. Heat source 20 is provided with fluid through heat source inlet tube 50. The cooled fluid leaves heat source 20 through heat source outlet tube 52. The flowing coolant in heat sink 14 may be forced against the outer surface of the sealed enclosure by jet impingement to stimulate a higher rate of heat transfer as demonstrated. (D. C. Johnson et al. "Improved Stirling Engine Performance Using Jet Impingement", 17th I.E.C.E.C. August 1982, Page 1845–49, *IEEE* 1982)

The failure of complete regenerative heat exchange typically results in incomplete cooling prior to isothermal expansion. Note FIG. 5*b* which shows an ideal Stirling heat pump cycle with perfect regenerative heat exchange and FIG. 5*c* which shows a more realistic cycle. Adiabatic, rather than isothermal expansion, permits a steeper slope in the PV diagram and more rapid temperature drop down to the desired expander design temperature. Note the improved entry conditions for an expander in FIG. 5*d*.

Similarly, incomplete regenerative heating and thermal pressurization during the constant volume heating portion of the cycle results in incomplete and insufficient pressurization prior to the compression stage. The upstream, insulated portion of compressor segment 12 will permit adiabatic, rather than isothermal compression. Adiabatic compression is steeper in the PV diagram and will cause sufficient compression heating to bring compression temperature to the level required for isothermal compression in realistic environments.

The gases in first segment 12, the compressor segment, with inward motion of vanes 40 will first be compressed adiabatically in the upstream, insulated portion of first segment 12 and then sink inlet tube 46. The heat sink cooling fluid leaves heat sink 14 through heat sink outlet tube 48. Heat source 20 is provided with fluid through heat source inlet tube 50. The cooled fluid leaves heat source 20 through heat source outlet tube 52. The flowing coolant in heat sink 14 may be forced against the outer surface of the sealed enclosure by jet impingement to stimulate a higher rate of heat transfer as demonstrated. (D. C. Johnson et al. "Improved Stirling Engine Performance Using Jet Impingement", 17th I.E.C.E.C. August 1982, Page 1845–49, *IEEE* 1982).

The failure of complete regenerative heat exchange typically results in incomplete cooling prior to isothermal expansion. Note FIG. 5*b* which shows an ideal Stirling heat pump cycle with perfect regenerative heat exchange and FIG. 5*c* which shows a more realistic cycle. Adiabatic, rather than isothermal expansion, permits a steeper slope in the PV diagram and more rapid temperature drop down to the desired expander design temperature. Note the improved entry conditions for an expander in FIG. 5*d*.

Similarly, incomplete regenerative heating and thermal pressurization during the constant volume heating portion of the cycle results in incomplete and insufficient pressurization prior to the compression stage. The upstream, insulated portion of compressor segment 12 will permit adiabatic, rather than isothermal compression. Adiabatic compression is steeper in the PV diagram and will cause sufficient compression heating to bring compression temperature to the level required for isothermal compression in realistic environments.

The gases in first segment 12, the compressor segment, with inward motion of vanes 40 will first be compressed adiabatically in the upstream, insulated portion of first segment 12 and then compressed in enhanced heat transfer contact with heat sink 14 with approximately isothermal compression. The adiabatic first phase encourages compression and the increase in gas temperature and the desired rejection of the heat of compression. After the gas is compressed, it experiences constant volume thermal pressure reduction in second segment 13. The gas travels between vanes 40 therein which have a fixed radial position while losing heat to fourth segment 17, the cooler, expanded constant volume segment through aligned heat transfer tubes 42.

Cooled, thermally depressurized, high pressure gas is first adiabatically expanded in the upstream insulated portion of expander segment 18 and then isothermally expanded within the central and downstream portions of expanding segment 18 of channel 37. This segment is in enhanced heat transfer contact with heat source 20. Vanes 40 therein move outward to increase the volume of the gas trapped between vanes 40. Heat enters expanding central and downstream segment 18 from heat source 20 to thereby cool heat source 20 and the fluids therein. Thus, approximately isothermal expansion occurs there in the central and downstream portion of expanding segment 18. The low pressure gas then experiences constant volume thermal pressurization in fourth segment 17 wherein the gas moves trapped between vanes 40 which have a fixed radial position. The low pressure gas is heated and thermally pressurized by the heat from second segment 13, the warmer, compressed constant volume segment. The heat for this thermal pressurization is transmitted to the gas therein through aligned heat transfer augmentation tubes 42. Thermally pressurized gas re-enters first segment 12, the compressor segment, wherein the gas is again compressed, first adiabatically and then approximately isothermally. Adiabatic compression occurs in the insulated upstream portion. Isothermal compression occurs in the uninsulated portion which is in intimate heat transfer contact with heat sink 14 to continue heat pump operation.

Improved compression and cooling is thereby achieved as shown in FIGS. and 5*d*. with the efficiency of a Stirling cycle heat pump and with important improvements of that cycle.

Figure 6:
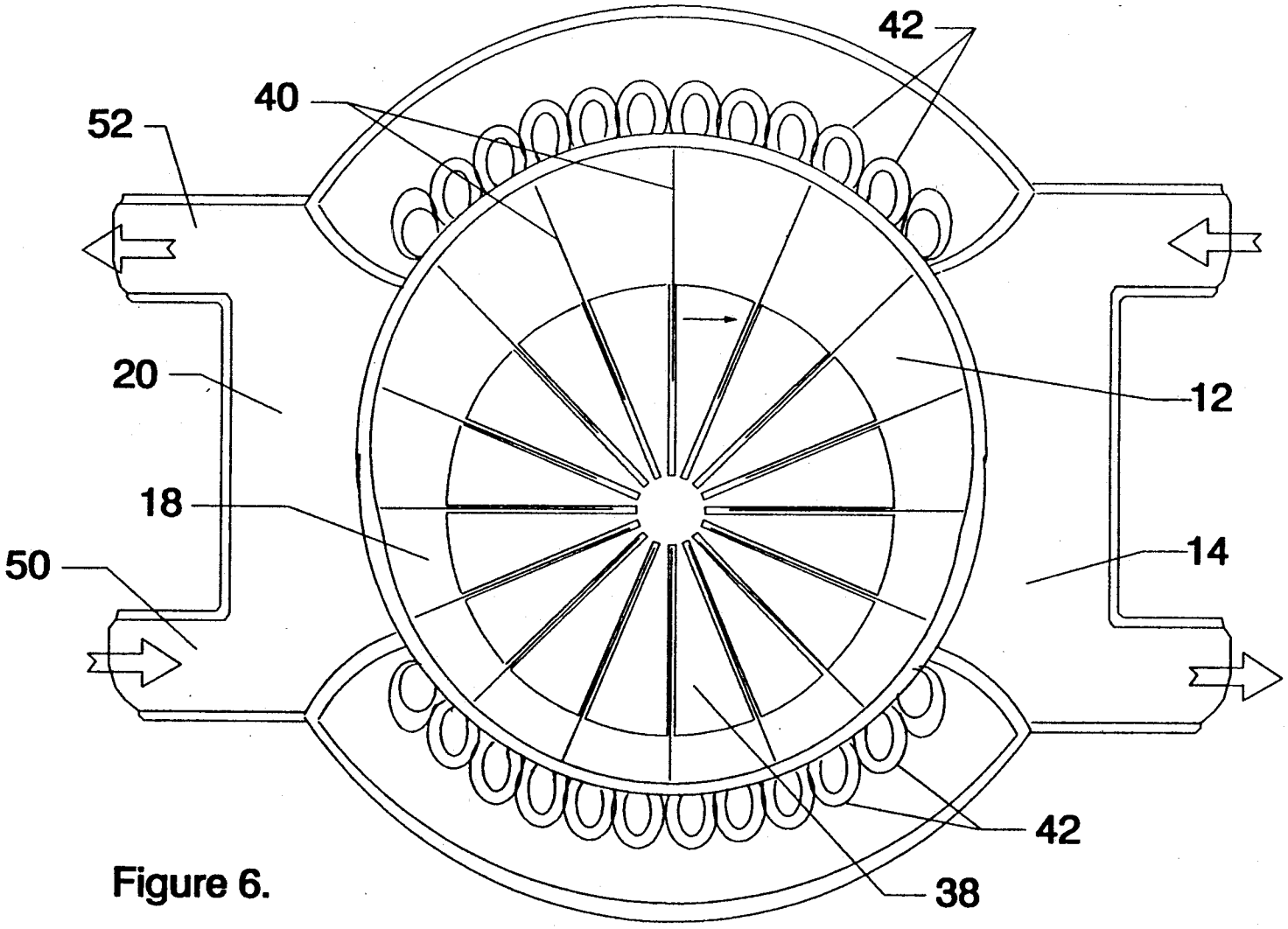
FIG. 6 Shows an interior cross-sectional view of a constant volume, constant flow, counter flow regenerative heat exchanger.

FIG. 6 shows a constant volume, constant flow, counterflow regenerative heat exchanger 64. Within a sealed enclosure 66 are a slotted rotor 68 and vanes 70 which are free to move within slots of slotted rotor 68. The interior wall of enclosure 66 forms two separate channels, a first channel 67 with the interior wall a fixed, relatively short radial distance from slotted rotor 68, and a second channel 69 with the interior wall of enclosure 66 a fixed and relatively greater distance from slotted rotor 68. Vanes 70 fit closely along the interior walls of enclosure 66.

A high pressure tube 72 directs high pressure gas from an isothermal compressor, not shown here, into first channel 67. A second high pressure tube 74 directs the cooled high pressure gas, which has been partially depressurized, out from first channel 67 and toward the high pressure inlet of an isothermal expander, not shown. A low pressure tube 76 directs gas from the isothermal expander, not shown, into the inlet of second channel 69. A second low pressure tube 78 directs the expanded gas out from larger, low pressure channel 69 towards the inlet of an isothermal compressor, not shown. Tubes, 72, 74, 76 and 78 are insulated.

Inter-channel seals 80 extend radially inward to fit closely with uniformly slotted rotor 68. The interior wall of enclosure 66 as well as gas tubes 72, 74, 76, and 78 have their innermost faces contoured to permit smooth transitions of vanes 70 from the extended position while moving within channels 67 and 69 to the completely retracted position of vanes 70 are in while moving past interchannel seals 80.

Parallel heat transfer tubes 82 extend between channel 67, the high pressure channel and channel 69, the low pressure channel. Tubes 82 are filled with heat conducting fluid, preferably with a high coefficient of thermal expansion. Heat pipes or heat conductive metal rods could be substituted for heat transfer tubes 82. A shaft 84 drives slotted rotor 68. Required bearings to support shaft 84 and required seals to seal the openings around shaft 84 are not shown. These components are so formed and arranged that:

Channel 67 has a uniform, relatively short radial dimension from slotted rotor 68. Channel 69 constricts vanes 70 to extend only a relatively short distance from the outer edge of slotted rotor 68. Channel 69 permits vanes 70 to extend a uniform, relatively greater distance from the outer edge of slotted rotor 68. Parallel heat transfer 82 tubes are so oriented that one extends from the inlet of channel 67 to the outlet of channel 69. Another extends from the inlet of 69 to the outlet of channel 67. Other aligned heat transfer tubes 82 extend between the central portion of channels 67 and 69. As a result, the warmest portions of channels 67 and 69 are in heat transfer contact with each other. The coolest portions of each channel are in heat transfer contact with the coolest portion of the other. Thus, temperature difference between the warmer gas and the cooler gas is minimized throughout channels 67 and 69 within counter-flow, constant flow regenerative heat exchanger 64. Thus, gas within high pressure channel 67 s thermally depressurized at constant volume by the loss of heat through heat transfer tubes 82 to the cooler gas within channel 69.

The gasses are thereby thermally depressurized and thermally pressurized, respectively, with regenerative heat transfer at constant volume and constant flow as required for a constant flow reverse Stirling cycle heat pump.

Although some detailed embodiments of the invention are illustrated in the drawings and previously described in detail, this invention contemplates any configuration, design and relationship of components which will function in a similar manner and which will provide the equivalent result.

I claim:

1. A constant flow reverse Stirling cycle heat pump system comprising:

a constant flow isothermal compression means for compressing a working gas, said compression means including a drive means, an inlet, and an outlet, and further including a cooling means to remove heat of compression from said working gas;

a constant flow isothermal expansion means for expanding said working gas, said expansion means including an inlet, an outlet, and a heat source means to provide isothermal expansion of said working gas while removing heat from said heat source means; and a constant volume regenerative heat exchange means for transferring heat from compressed working gas to expanded working gas, said constant volume regenerative heat exchange means comprising:

an enclosure, said enclosure containing a high pressure portion with an inlet receiving compressed working gas from said compression means outlet and with an outlet discharging regeneratively cooled working gas to said expansion means inlet, a low pressure portion with an inlet receiving expanded working gas from said expansion means outlet and with an outlet discharging regeneratively heated working gas to said compression means inlet, a slotted rotor in a central portion of said enclosure, said rotor containing a plurality of radially extending slots, and a plurality of radially sliding vanes mounted in said slots and extending to seal against a wall of said enclosure, wherein a first portion of said wall having a constant first radial distance from said rotor cooperates with said vanes to form a first constant volume channel defining said high pressure portion and a second portion of said wall having a constant second radial distance from said rotor cooperates with said vanes to form a second constant volume channel defining said low pressure portion, said first radial distance being less than second radial distance; and heat transfer means in thermal contact with said high pressure portion and said low pressure portion for transferring heat from said compressed working gas to said expanded working gas.

2. The apparatus of claim 1 wherein said constant flow isothermal expansion means includes a means for extracting work.

3. The apparatus of claim 1 wherein said heat transfer means comprises heat conductive, fluid filled heat transfer tubes.

4. The apparatus of claim 1 wherein said heat transfer means comprises heat pipes.

5. The apparatus of claim 1 wherein said heat transfer means comprises solid rods formed of heat conductive material.

6. The apparatus of claim 1 wherein said compression means is formed by a segment within said enclosure between said low pressure portion and said high pressure portion wherein a compression portion of said wall having a decreasing radial distance from said rotor in a direction of rotor rotation cooperates with said vanes to form a constant flow compressor; and said expansion means is formed by a segment within said enclosure between said high pressure portion and said low pressure portion wherein an expansion portion of said wall having an increasing radial distance from said rotor in a direction of rotor rotation cooperates with said vanes to form a constant flow expander.

* * * * *